United States Patent [19]

Paschetto

[11] 4,174,838

[45] Nov. 20, 1979

[54] GOLF PUTTER ALIGNING DEVICE

[76] Inventor: Paul E. Paschetto, 136 Melwood Ave., East Longmeadow, Mass. 01028

[21] Appl. No.: 920,814

[22] Filed: Jun. 30, 1978

[51] Int. Cl.[2] ..... A63B 69/36

[52] U.S. Cl. ..... 273/163 A

[58] Field of Search ..... 273/77 R, 162 R, 163 R, 273/163 A, 164, 183 D, 183 E, 186 R, 186 A, 186 C, 190 R, 190 A; 33/391, 392, 399

[56] References Cited

U.S. PATENT DOCUMENTS

| | | | |
|---|---|---|---|
| 1,459,705 | 6/1923 | Bullock | 273/190 A |
| 3,126,206 | 3/1964 | Sabia | 273/193 R X |
| 3,198,525 | 8/1965 | Smith | 273/163 R |
| 3,253,829 | 5/1966 | Ford | 273/183 D |
| 3,273,892 | 9/1966 | Nolting | 273/163 A |
| 3,273,893 | 9/1966 | Duncan | 273/163 A |
| 3,298,693 | 1/1967 | Eisenberg | 273/183 D |
| 3,326,558 | 6/1967 | Eaton | 273/186 R X |
| 3,437,339 | 4/1969 | Starck | 273/190 A X |
| 3,495,834 | 2/1970 | Tanczos | 273/163 A |

FOREIGN PATENT DOCUMENTS

| | | | |
|---|---|---|---|
| 708084 | 4/1965 | Canada | 273/163 A |

*Primary Examiner*—Richard J. Apley
*Attorney, Agent, or Firm*—Michael J. Murphy

[57] ABSTRACT

In a golf putter aligning device the improvement comprising a pendulum to aid in positioning a golfer's head in the vertical direction with respect to a ball, such pendulum being mounted for pivoted movement with respect to a horizontal pointer serving to align the putter with respect to the ball.

5 Claims, 4 Drawing Figures

Fig. 1.
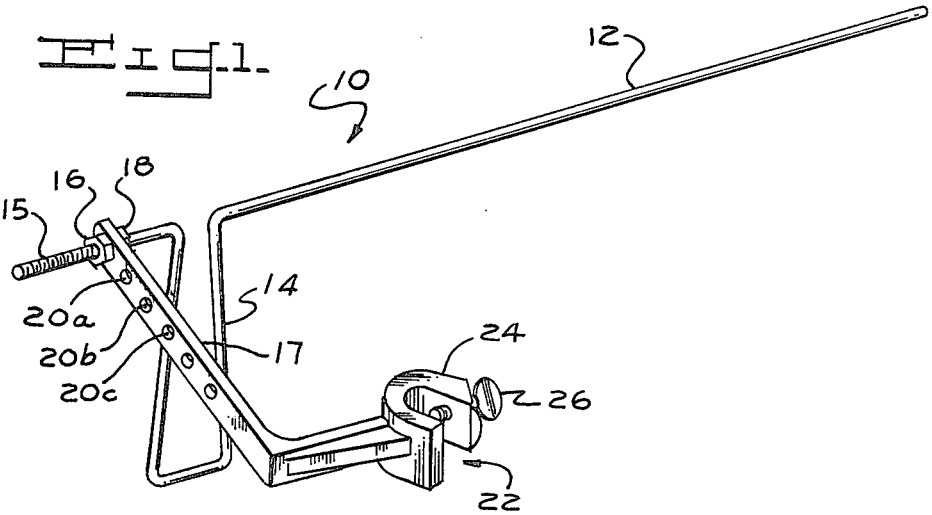
Fig. 2.
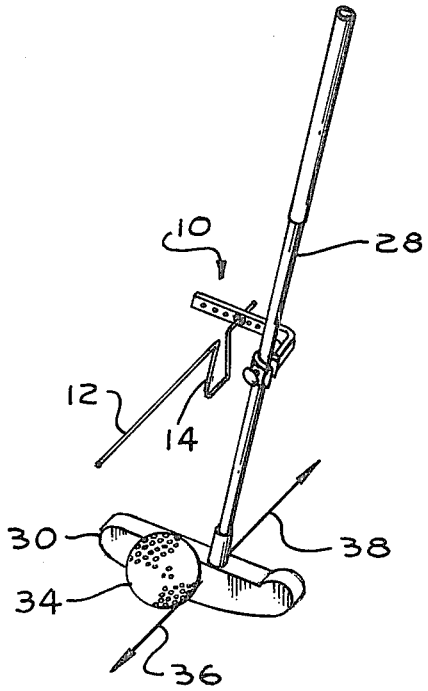
Fig. 3.
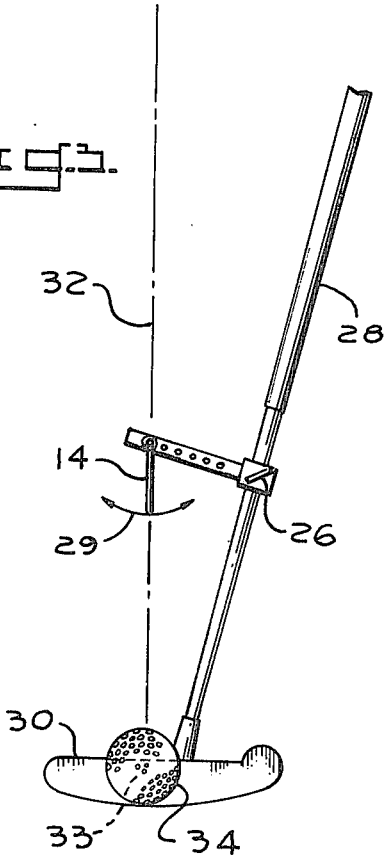
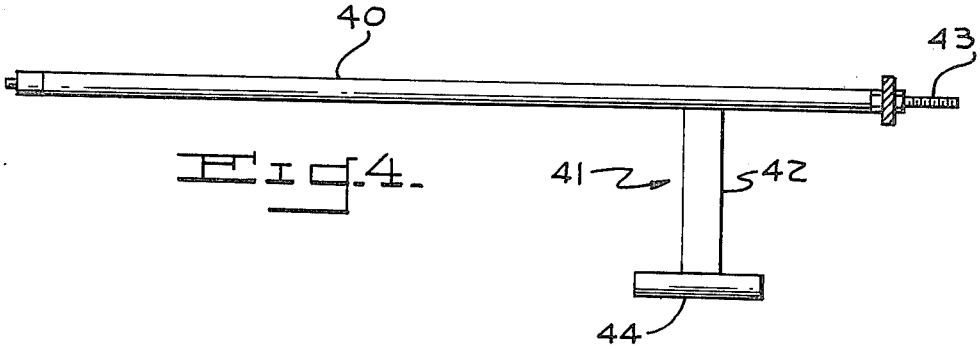
Fig. 4.

GOLF PUTTER ALIGNING DEVICE

BACKGROUND OF THE INVENTION

This invention relates to an improved golf training aid and more particularly to a portable attachment for a golf putter which promotes both proper positioning of the user's head and alignment of the putter with respect to the golf ball.

Previous golf putting sighting devices have required either the proper position to be assumed by the golfer or proper orientation of the putter head in order to benefit fully from use of the device. Elimination of either of these problems permits a less than experienced golfer to concentrate on correcting other errors in his game and bettering his score overall.

SUMMARY OF THE INVENTION

Accordingly, it is the principal object of this invention to provide an improved golf putter training device.

Another object is to provide such a device which facilitates proper positioning of the golfer with his putter as well as assisting such golfer in aligning the face of the putter so that it will propel the ball along the desired line to the cup.

Other objects of this invention will impart the obvious and will in part appear from the following description and claims.

These and other objects are accomplished in a golf putter aligning device by providing the improvement which comprises, in combination, pendulum means to aid in positioning a golfer's head in the vertical direction with respect to a ball, such means being mounted for pivoted movement with respect to a substantially horizontal pointer for aligning the putter with respect to the ball.

BRIEF DESCRIPTION OF THE DRAWING

In describing the overall invention, reference will be made to the accompanying drawing wherein:

FIG. 1 is a perspective view of one embodiment of a device according to the invention;

FIG. 2 is a view of the device of FIG. 1 in place on a golf putter;

FIG. 3 is an elevational view of the device of FIG. 1 illustrating its manner of use; and FIG. 4 is an elevational view of an alternate embodiment of a device according to the invention.

DETAILED DESCRIPTION OF THE ILLUSTRATED EMBODIMENTS

Referring now to the drawings, a golf putter aligning device 10 is shown in FIG. 1 which comprises a rigid member in the form of a wire rod which includes pendulum means 14 comprising generally u-shaped extension in the vertical direction of a horizontal elongated pointer 12. Pendulum means 14, in a manner to be further described, serves to aid in positioning a golfer's head in a vertical direction with respect to golf ball 34 while pointer 12 serves to align the head 30 of the putter with respect to such ball. Pendulum means 14 is mounted for pivoted movement in a plane parallel with that containing the hitting face of putter head 30. More specifically, device 10 has a threaded end 15 which is removably inserted in one of preferably a series of through-holes 20*a*, 20*b*, 20*c* in support arm 17, which extends generally at 90 degrees from pointer 12 when in operative position on a putter shaft 28. End 15 is loosely held in one of such through-holes, for example by means of outside retaining nut 16 and inside retaining nut 18 threaded on end 15 of the pointer portion of device 10. Alternative bearing means could be used to support end 15 in arm 17. Device 10 is manually detachably secured by the golfer as illustrated in FIG. 2, on the lower portion of shaft 28 of a golf putter above head 30. This is accomplished with clamp means 22 (FIG. 1) comprising C-clamp 24 having a threaded bore containing screw 26 which is axially movable in such bore into forced contact with and away from putter shaft 28 to hold the device rigidly in place and release it therefrom as desired.

In the FIG. 4 embodiment a tubular member 40 is shown enclosing a shaft 43 of similar diameter to that of FIG. 1 which supports such member 40. Pendulum means 41 in this embodiment comprises pendulum arm 42 rigid with member 40 having a horizontally extending weighted end 44 at its lower extremity.

In use, device 10 is attached via clamp means 22 along the lower portion of golf putter shaft 28 in the manner of FIG. 2 close above head 30 so that pointer 12 appears directly over the so-called "sweet spot" 33 (FIG. 3) of the putter head 30 which is the place along the hitting face of the head intended to come into actual hitting contact with ball 34 and which is usually, though not necessarily marked with a line or equivalent indicia. Pendulum means 14, 41 under such condition is meant to hang straight down under the influence of gravity directly over spot 33 when the golfer assumes his putting stance. Such positioning over spot 33 of the pendulum means, which is free to swingably move in the direction of arrowed line 29 in FIG. 3 under the influence of gravity, is accomplished by inserting the device 10 into whichever one of the series of holes 20*a*, 20*b*, 20*c*, in arm 17 which results in the pendulum being in the desired location for the particular golfer's stance. Pointer 12 is adjusted to be perpendicular to the hitting face of putter head 30 by turning the entire assembly on the shaft before final tightening of the clamp 24.

When the device has been properly positioned on the golf club shaft, pendulum means 14, 41 hangs straight down such that arm 42 and at least most of the horizontal thickness of end 44 in the embodiment of FIG. 4 or the vertical sides of the generally u-shaped extension of FIG. 1 is hidden from the golfer's sight as long as he is looking directly down at the ball such as along sight line 32 in FIG. 3. In other words, his head is in the proper putting position and it is from this fixed reference point that he is then able to make adjustments in his posture, feet placement and the like, to either stand closer to or further from the ball. The pointer 12, 40 acts as a sighting device to aid the golfer in aiming the club towards the target hole and insuring that his back stroke along the direction 38 is in the same plane as that along which ball 34 rolls illustrated at 36 in FIG. 3. After assuring that the pendulum means is in the plane 32 of the golfer's line of sight, the golfer is able to develop a straight back stroke by keeping the pointer 12, 40 centered over ball 34 during such back stroke along plane 36, 38. Any deviation from this is readily apparent by observing the movement of the pointer with respect to the ball. Errors such as shakiness, opening or closing of the face of the putter head 30 and the like are magnified by the length of the pointer 12, 40 and made readily apparent to the golfer. At the completion of the putting stroke, the golfer is able to determine whether or not the proper follow-through has been achieved as the pointer 12, 40 if properly used should be aimed at the target hole in the plane of lines 36, 38.

Though the device of the invention has been shown in the illustrated embodiments as a portable device for attachment to a putter, it is within the scope of the invention to provide the device as an integral part of the club per se.

The above description and particularly the drawing is set forth for purposes of illustration only and is not to be taken in a limited sense. Various modifications and alterations will be readily suggested to persons skilled in the art. It is intended, therefore, that the foregoing be considered as exemplary only and that the scope of the invention be ascertained from the following claims.

What is claimed is:

1. In combination with a golf putter having a shaft with a head at its lower end, a horizontal pointer for aligning the head with respect to a ball, pendulum means mounted for free swinging, pivoted movement with respect to the pointer for aiding in positioning a golfer's head in a vertical direction with respect to the ball and clamping means removably securing the pendulum means and pointer to the shaft over the head.

2. The device of claim 1 including an arm between the clamping means and the pendulum means extending over the head of the putter having a series of holes in which said pointer and pendulum means may be selectively supported.

3. The device of claims 1 or 2 wherein said pendulum means is a weighted pendulum arm extending downwardly from the pointer.

4. The device of claims 1 or 2 wherein said pendulum means is a downwardly extending integral extension of the pointer.

5. The device of claim 1 wherein said movement occurs as a result of gravity on movement of the putter shaft in a vertical plane toward or away from the ball.

* * * * *